United States Patent [19]

Wendt

[11] Patent Number: 4,570,390

[45] Date of Patent: Feb. 18, 1986

[54] PARTITION SYSTEM ADAPTED TO SUPPORT A CANTILEVERED LOAD

[75] Inventor: Alan C. Wendt, Barrington, Ill.

[73] Assignee: United States Gypsum Company, Chicago, Ill.

[21] Appl. No.: 551,424

[22] Filed: Nov. 14, 1983

[51] Int. Cl.[3] ..... E04B 2/00

[52] U.S. Cl. ..... 52/36; 52/282; 52/729; 248/243; 211/90; 211/190

[58] Field of Search ..... 52/36, 729; 248/235, 248/224.4, 243; 211/90, 190, 207, 282

[56] References Cited

U.S. PATENT DOCUMENTS

| | | | |
|---|---|---|---|
| 3,203,151 | 8/1965 | Bransford | 52/729 |
| 3,394,507 | 7/1968 | Doke | 52/36 |
| 3,407,547 | 10/1968 | Doke et al. | 52/729 |
| 3,566,561 | 3/1971 | Tozer | 52/729 |
| 3,648,419 | 3/1972 | Marks | 52/36 |
| 3,730,477 | 5/1973 | Wavrunek | 52/36 |
| 3,778,939 | 12/1973 | Nelsson | 52/36 |
| 3,782,048 | 1/1974 | Corman | 52/282 |
| 3,810,340 | 5/1974 | Nelsson | 52/729 |
| 3,828,495 | 8/1974 | Law | 52/36 |
| 4,231,197 | 11/1980 | Caplan et al. | 52/36 |
| 4,356,672 | 11/1982 | Beckman et al. | 52/36 |
| 4,441,300 | 4/1984 | Varon et al. | 52/36 |
| 4,443,979 | 4/1984 | Varon et al. | 52/36 |

OTHER PUBLICATIONS

Sweet's Catalog, 9.1/Ce, 1979; pp. 1–3, 8.

Ceiling Dynamics Inc. advertising brochure, undated; 4 pages.

*Primary Examiner*—Henry E. Raduazo

*Assistant Examiner*—C. Dennison

*Attorney, Agent, or Firm*—Robert M. Didrick; Samuel Kurlandsky; Robert H. Robinson

[57] ABSTRACT

A slotted standard adapted to receive a shelf bracket or the like is fastened to a metal stud having a longitudinal channel defined by the fingers of a furcated extension of the sutd's web. The walls of the channel are either threaded or threadable to receive a screw which passes through the standard and fastens the standard to ledges on both sides of the channel opening. When placed in a partition, the stud serves as an anchor for the standard so that a bracket may be attached to the standard in order to support a shelf, a piece of furniture or the like.

10 Claims, 6 Drawing Figures

PARTITION SYSTEM ADAPTED TO SUPPORT A CANTILEVERED LOAD

Conventional drywall construction systems provide for the mounting of shelves and heavy articles such as furniture on wallboard partitions by means of brackets inserted into slotted standards fastened to studs in the partitions. It is desirable that such systems be strong, adjustable, inexpensive, simple to install, and inconspicuous when not being employed to support such articles.

Attempts have been made in the past to provide mounting systems having one or more of such desirable attributes. In U.S. Pat. No. 3,394,507, Doke teaches a stud having laterally opposed flanges flanking a channel. A slotted standard is attached to the flanges so that the slots open into the channel. Wallboard is fastened to the flanges with screws. Thus, a standard must be placed within a stud at every location where a shelf may be desirable in the future before the wallboard is placed into position. Failing that, the partition would have to be dismantled to insert the standards whenever relocation of shelves is desired. Also, the slots of adjacent standards must be carefully aligned before the standards are fastened so that the shelves or other objects will be level when mounted.

Nelsson teaches an integral stud and standard in U.S. Pat. No. 3,810,340. Such studs must be carefully measured and installed in order to align the slots of adjacent studs.

It is an object of this invention to provide a system for the construction of drywall partitions on which shelves and heavy objects may be mounted.

It is another object of this invention to provide a system for mounting heavy objects on drywall partitions which is inexpensive and simple to install.

It is another object of this invention to provide a stud for drywall construction which allows virtually unlimited adjustment of a slotted standard up and down the length of the stud after the wallboard has been affixed to the stud.

It is a further object of this invention to provide a system for supporting a cantilevered load on a vertical wall.

It is yet another object of this invention to provide a system for mounting heavy objects on walls which is inconspicuous when not being so employed.

It is a still further object of this invention to provide a system for mounting heavy objects on drywall partitions which does not require the drilling of holes in the stud components of the partition to accommodate fasteners for the slotted standards.

These and other objects which will be apparent from the drawings and the following description are achieved by the partition system of this invention which utilizes a stud having a web which comprises a plate portion and a channel portion, the walls of the channel having confronting threaded or threadable facets so that the channel may accept a screw at any level, and a pair of opposed flanges extending laterally from said web. The flanges and the channels are symmetrical about the centerline of the plate portion of the web. A pair of flanges in this context means one or more pairs of flanges. The screw may be any threaded fastener such as a wood screw, machine screw, bolt, self-tapping sheet metal screw, or the like. Thus, the threaded facets may be tapered to conform to a wood screw or they may be parallel.

The studs of this invention are interspersed among those commonly used in the interconnecting framework of studs and runners in a partition. A pair of the studs of this invention, often but not necessarily consecutively placed, are required for the proper support of long shevles which rest on brackets projecting out from the wall. The use of one such stud is contemplated, however, where the load is concentrated along the centerline of a projecting bracket such as a coat rack or the fulcrum of a child's teeter-totter in a day care center.

The partition system of this invention comprises a framework utilizing one or more studs of this invention, wallboards fastened to the framework, and the requisite number of slotted or notched standards fastened to the channeled and threaded studs, thus adapting the studs to the mounting of brackets by the insertion of bracket hooks into the slots or notches of the standard.

Turning now to the drawings.

Figure 1:
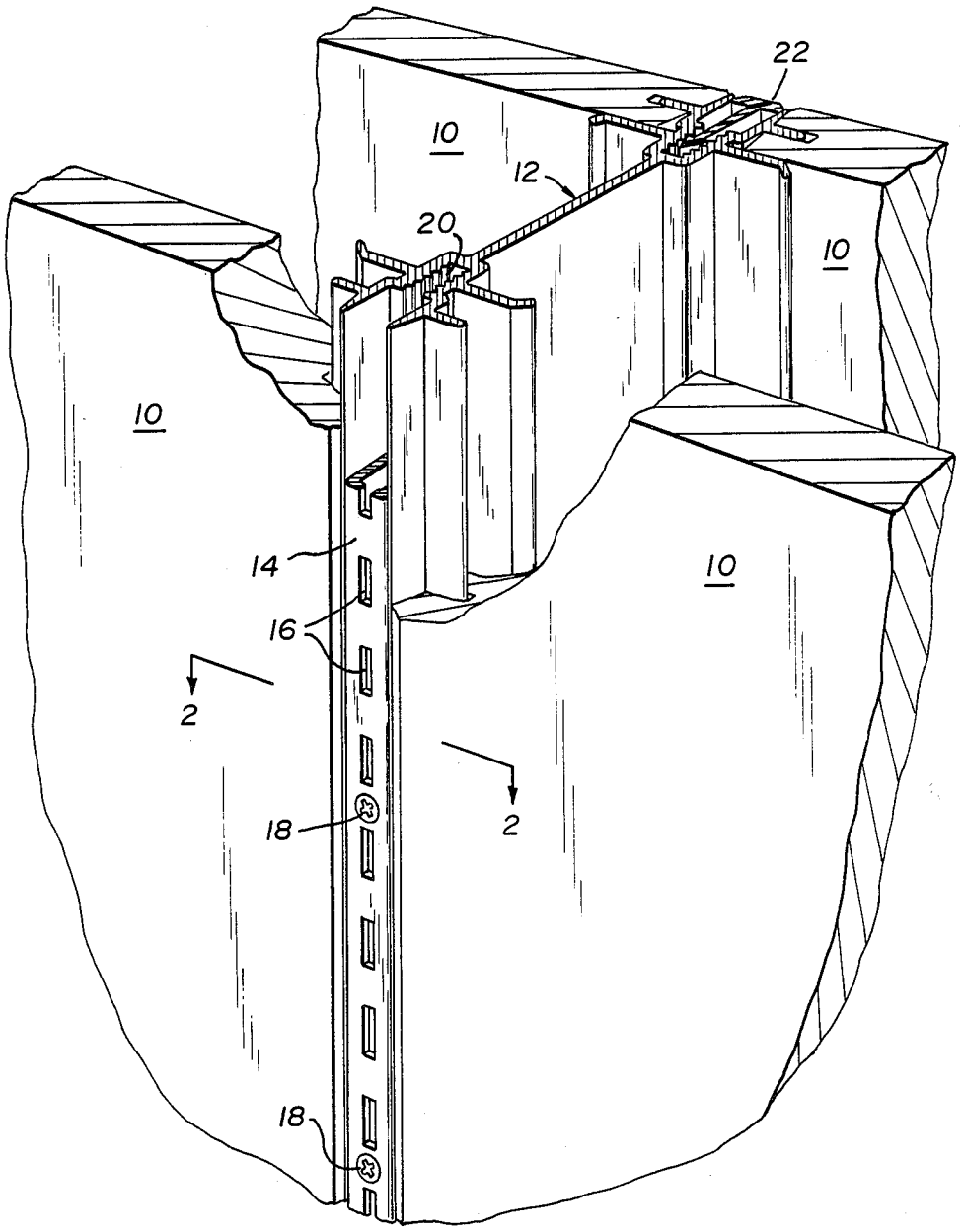
FIG. 1 is a perspective view, partially cut away, of a preferred embodiment of the invention.

In FIG. 1, the panels 10 are held upright by the extruded aluminum stud 12, and the shelf standard 14, having a column of slots 16, is fastened to the stud 12 by a plurality of screws 18 turned into the threaded channel 20. A filler trim piece 22 is pressed into place where a standard 14 is not required.

Figure 2:
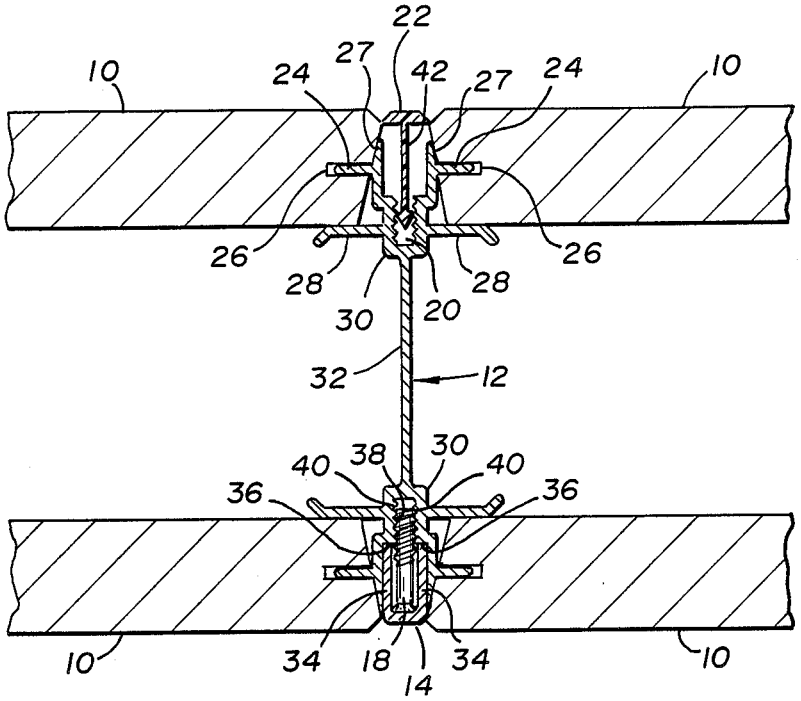
FIG. 2 is a sectional view of the partition system of FIG. 1, taken along line 2—2.

In FIG. 2, the panels 10 are attached to the stud 12 by the insertion of the opposing kerf flanges 24 into the kerfs 26 and the panels 10 are spaced apart by the stops 27 and braced by the opposing buttress flanges 28. The flanges 24 extend laterally from their respective stops 27 and the flanges 28 likewise extend laterally from the channel housings 30 which are U-shaped extensions of the web 32. The legs 34 of the slotted standard 14 are forced against the ledges 36 of the housings 30 by the engagement of the screw 18 with the threads 38 on the opposing interior walls 40 of the channel housing 30. The trim piece 22, which may be made of a vinyl plastic or other deformable material, is held in place by an anchor leg 42 which fits snugly within the threaded channel 20.

Figure 3:
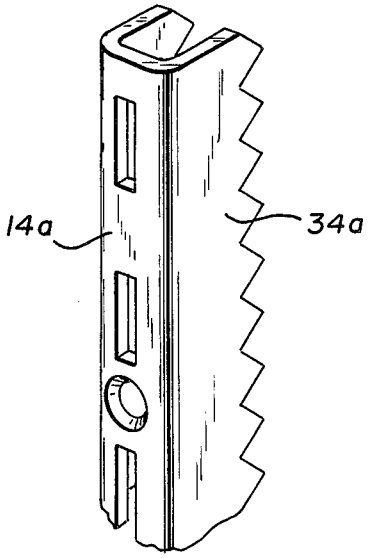
FIG. 3 is a perspective view of a shelf standard contemplated as a component of the construction system of this invention.

The standard **14*a* of FIG. 3 may be substituted for the standard 14 of FIGS. 1 and 2. The serrated legs 34*a* tend to dig into the ledges 36** and offer increased resistance to slippage when a load is applied to the system.

Figure 4:
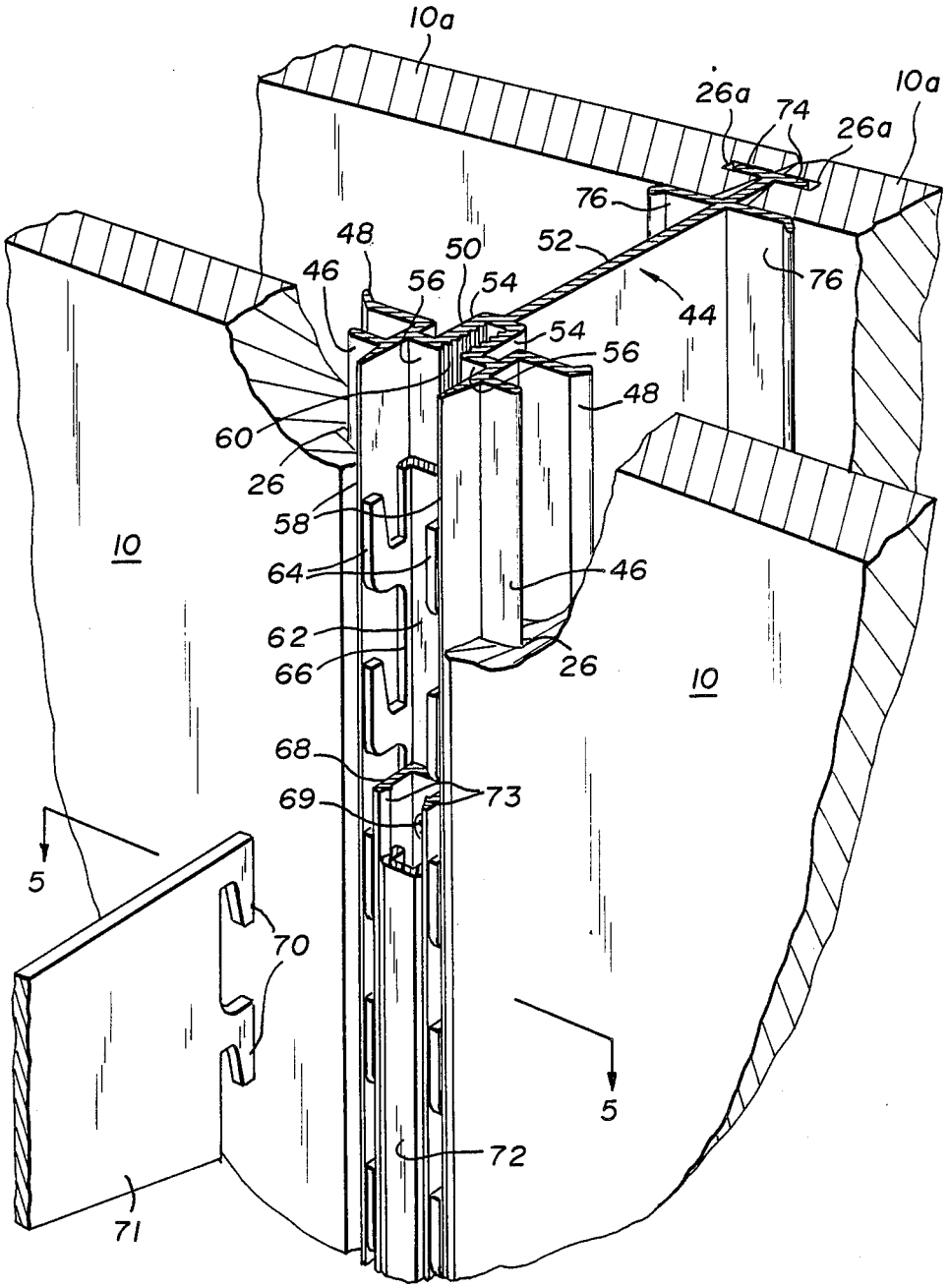
FIG. 4 is a perspective view, partially cut away, of a partition system of this invention and of a bracket to be mounted thereon.
Figure 5:
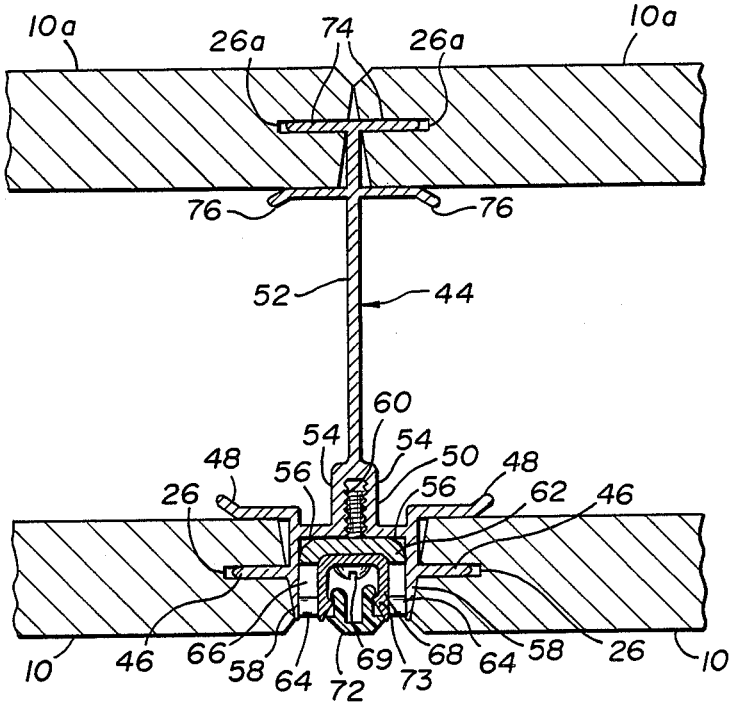
FIG. 5 is a sectional view of the partition system of FIG. 4, taken along line 5—5.

In FIGS. 4 and 5, the panels 10 are attached to the stud 44 by the insertion of the opposing kerf flanges 46 into the kerfs 26 and the panels 10 are braced by the opposing buttress flanges 48. The flanges 46 and 48 each extend laterally from the channel housing 50 which is an extension of the web 52 and which consists of the walls 54, the ledges 56, the stops 58 and the screw threads 60. The standard 62, shown in FIG. 4, has a column of hooks 64 stamped out of each leg 66 and is fastened to the channel housing 50 by the shackle 68 and one or more screws 69. The standard 62 is thus adapted to receive the hook 70 of a bracket 71. The shackle 68 and the screws 69 are hidden by a trim piece 72 which is snapped over the nubs 73 of the shackle 68 as shown more clearly in FIG. 5. The stud 44 is used in a partition when it is not desired to hang shelves or other heavy objects on directly opposite sides of the partition. Thus, the panels 10*a* are attached to the stud 44 by a pair of opposing kerf flanges 74 which extend laterally from the web 52 into the kerfs 26*a* of the panels 10*a*. The opposing buttress flanges 76 also extend laterally from the web 52 to brace the panels 10*a* against bumps near the vulnerable kerf area.

Figure 6:
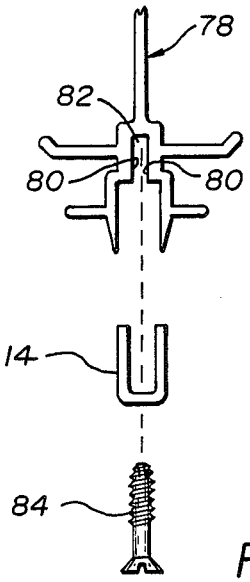
FIG. 6 is an exploded top plan view showing the relation between a stud of this invention, a standard, and a self-tapping screw in a system of this invention.

The stud 78 in FIG. 6 is similar to the stud 12 of FIGS. 1 and 2 in all respects except that the interior walls 80 of the channel housing 82 are not threaded but are threadable by the self-tapping screw 84 as it is turned into the housing to fasten the standard 14 to the stud.

The load bearing capacity of the shelf mounting system of this invention was tested as follows. An 8′×8′ (about 2.4 m×2.4 m) partition was built using a stud of this invention between two of the gypsum wallboard panels. A 4 foot long U-shaped, slotted standard, the legs of which were not serrated, was fastened to the stud with 5 flat-head, ¼″×1-¼″ (about 6.4 mm×32 mm) machine screws. The lowest end of the standard did not rest on the floor. A shelf bracket, reinforced with angle iron to prevent twisting of the sheet metal under load, was inserted in the standard and a hydraulic ram was mounted above the bracket with the shaft of the ram directed downward to just touch the bracket. A deflection gauge was fastened to the standard to measure the amount of its downward slippage. The ram was then actuated to apply a load at a constant rate of increase. Gauge readings were taken at 25 pound (about 1.2 Newton) intervals and the load was removed after each increment so that zero load readings could be taken. A first slippage of 0.002 inch occurred at a load of 100 pounds (4.6 Newtons). At 525 pounds (about 24.3 Newtons), the standard had slipped down about 0.1 inch (about 2.5 mm). The test was terminated when, at a load of 536 pounds (24.8 Newtons), the bracket broke. No damage to the stud or to the standard was observed.

While several particular embodiments of this invention have been described, it will be understood that the invention may be modified within the spirit and scope of the appended claims.

The subject matter claimed is:

1. A wallboard partition which comprises:

an upright metal stud comprising a longitudinal web having a central plate portion and a consecutively furcated portion, and a pair of flanges extending laterally from the furcated portion and away from each other; the furcated portion defining a longitudinal, two-tiered channel, the first tier being proximate to the plate and having confronting facets adapted to engage the threads of a screw, the second tier being wider than the first and having an unobstructed mouth distal to the plate; and a wallboard panel having a front side, a back side and an edge between said sides, said edge having a kerf into which a stud flange extends.

2. The partition of claim 1 wherein the kerf engaging flange extends from the second tier of the channel.

3. The partition of claim 1 characterized further by a frontally removable slotted U-shaped standard nested within the second tier and fastened to the first tier of the channel.

4. The partition of claim 1 wherein a first pair of flanges extends from the first tier of the channel and a second pair of flanges extends from the second tier.

5. The partition of claim 4 wherein a flange of the second pair extends into the kerf of the wallboard panel and a flange of the first pair abuts the backside of the panel.

6. A metal stud adapted to the support of a cantilevered load comprising a longitudinal web comprising a plate portion and a longitudinal channel housing, said housing having a base which is intersected by the plate, spaced-apart walls which extend from the base beyond the plate, a ledge extending laterally from each other in plane parallel to the base, said walls being parallel to each other from the base to the ledge and having confronting facets adapted to engage the threads of a screw, and a terminal finger projecting at a right angle from each ledge further beyond the plate, said stud having a flange extending laterally outward from the finger and being adapted to extend into a kerfed edge of a wallboard, said channel housing being adapted to the frontal insertion of a standard.

7. The stud of claim 6 characterized further in that the channel has two sectors, the first being bounded by the base and the walls extending therefrom, and the second being bounded by the ledges and the fingers projecting therefrom.

8. The stud of claim 7 wherein the housing of the second sector consists of the ledges and the fingers projecting therefrom.

9. The stud of claim 7 wherein a pair of oppositely directed flanges extends from the housing of the second sector.

10. The stud of claim 9 characterized further by a pair of oppositely directed flanges extending from the housing of the first sector.

* * * * *

UNITED STATES PATENT AND TRADEMARK OFFICE

CERTIFICATE OF CORRECTION

PATENT NO. : 4,570,390
DATED : February 18, 1986
INVENTOR(S) : Alan C. Wendt

It is certified that error appears in the above—identified patent and that said Letters Patent is hereby corrected as shown below:

IN THE CLAIMS:

Claim 6, line 29, after "each" and before "other" insert --wall, said ledges being distal from the base and extending away from each--.

Signed and Sealed this

*Twelfth* Day of *August 1986*

[SEAL]

*Attest:*

DONALD J. QUIGG

*Attesting Officer*

*Commissioner of Patents and Trademarks*